US007194232B2

(12) United States Patent
Kitagawa et al.

(10) Patent No.: US 7,194,232 B2
(45) Date of Patent: Mar. 20, 2007

(54) IMAGE FORMING APPARATUS INCLUDING INTERMEDIATE TRANSFER DEVICE

(75) Inventors: Yusuke Kitagawa, Iwatsuki (JP); Masato Serizawa, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 15 days.

(21) Appl. No.: 11/000,906

(22) Filed: Dec. 2, 2004

(65) Prior Publication Data

US 2005/0254863 A1 Nov. 17, 2005

(30) Foreign Application Priority Data

May 17, 2004 (JP) ..... 2004-146485

(51) Int. Cl.
*G03G 15/20* (2006.01)

(52) U.S. Cl. ..... 399/297; 399/123

(58) Field of Classification Search ..... 399/123, 399/297

See application file for complete search history.

(56) References Cited

U.S. PATENT DOCUMENTS 6,035,158 A * 3/2000 Asakura et al. ..... 399/123

6,477,344 B1 * 11/2002 Asakura et al. ..... 399/101

FOREIGN PATENT DOCUMENTS

JP 2003-98839 A 4/2003

* cited by examiner

*Primary Examiner*—David M. Gray
*Assistant Examiner*—Ruth N. LaBombard
(74) *Attorney, Agent, or Firm*—Sughrue Mion, PLLC

(57) ABSTRACT

An image forming apparatus including an intermediate transfer device capable of making a change in a degree of expansion and contraction of an intermediate transfer belt slow is provided. A position and a moving range of a cleaning roll are set in order to make a rear surface contact position on a rear surface of the intermediate transfer belt relative to the contact position where the cleaning roll comes in contact with the intermediate transfer belt, away from a cleaning backup roll while an intermediate transfer belt cleaner rocks and moves to a contact position of the cleaner. Because of the intermediate transfer belt being not sandwiched between the cleaning and backup rolls, the change in the degree of expansion and contraction of the intermediate transfer belt is made slow, and the intermediate transfer belt is kept to have the degree of expansion and contraction within a predetermined range.

12 Claims, 6 Drawing Sheets

IMAGE FORMING APPARATUS INCLUDING INTERMEDIATE TRANSFER DEVICE

CROSS-REFERENCE TO RELATED APPLICATIONS

This application claims priority under 35 US 119 from Japanese Patent Application No. 2004-146485, the disclosure of which is incorporated by reference herein.

BACKGROUND OF THE INVENTION

1. Field of the Invention

The present invention relates to an intermediate transfer device and an image forming apparatus.

2. Description of the Related Art

In an image forming apparatus that primarily transfers toner images onto an intermediate transfer belt and that secondarily transfers the toner images onto a recording medium such as a paper sheet, it is necessary to remove toners (transfer residual toners) remaining on a toner carrying surface of the intermediate transfer belt.

Normally, as the intermediate transfer belt, a belt that has no elasticity in a stretching direction is employed. In recent years, there has been proposed an image forming apparatus using an elastic intermediate transfer belt to realize improvement in adhesiveness to a photoreceptor and the like, thereby enabling the enhancement of an image quality and the design of a smaller image forming apparatus at low cost.

For example, Japanese Patent Application Laid-Open No. 2003-98839 discloses a cleaner that employs an elastic intermediate transfer belt, that includes a cleaning roll in contact with the intermediate transfer belt at positions opposed to a stretching roll, that causes the intermediate transfer belt to be along a part of a peripheral surface of each cleaning roll, and that includes an auxiliary roll that presses the intermediate transfer belt.

According to the cleaner structured as described in the Japanese Patent Application Laid-Open No. 2003-98839, the cleaning roll is moved away from the intermediate transfer belt, and this operation sometimes causes the intermediate transfer belt to be sandwiched between the cleaning roll and the stretching roll or the cleaning roll and the auxiliary roll. The probability of sandwiching the intermediate transfer belt therebetween is higher, in particular in case of unevenness occurred during the manufacture or assembly of the cleaning roll and the like. Because the intermediate transfer belt is elastic, a degree of expansion and contraction of the belt changes when being partially put between the rolls during circulation.

SUMMARY OF THE INVENTION

A first aspect of the present invention is an intermediate transfer device which includes an intermediate transfer belt, a cleaning member and a cleaning member support mechanism. The intermediate transfer belt is formed endlessly with elasticity at least in a circulation direction, supported by a plurality of belt support members and is capable of circulating. The cleaning member comes in contact with a toner carrying surface of the intermediate transfer belt to remove a toner on the toner carrying surface of the intermediate transfer belt. The cleaning member support mechanism movably supports the cleaning member in order to make a cleaning surface of the cleaning member come into contact with or out of contact with the toner carrying surface. In this intermediate transfer device, the cleaning member is arranged to make a rear surface of the intermediate transfer belt come at a contact position, at which the cleaning surface is brought into contact with the toner carrying surface by the cleaning member support mechanism, is at a position away from the belt support members.

In this intermediate transfer device, the rear surface of the intermediate transfer belt at the contact position, at which the cleaning surface is brought into contact with the toner carrying surface, is located away from the belt support members. Therefore, while the cleaning surface is in contact with the toner carrying surface, the intermediate transfer belt is not put between the cleaning member and the belt support member. Accordingly, a change in a degree of expansion and contraction of the intermediate transfer belt during a cleaning operation can be made slow.

A second aspect of the present invention is an image forming apparatus which has the above-stated intermediate transfer device, a primary transfer section that primarily transfers a toner image onto the intermediate transfer device, and a secondary transfer section that secondarily transfers the toner image on the intermediate transfer belt onto a recording medium.

According to this image forming apparatus, an image is primarily transferred from the primary transfer section to the intermediate transfer device, this resultant image is further secondarily transferred to the recording medium by the secondary transfer section, and a desired image is formed on the recording medium. Because the image forming apparatus includes the above-stated intermediate transfer device and can make change in the degree of expansion and contraction of the intermediate transfer belt slow, a high quality image with fewer irregularities can be obtained.

BRIEF DESCRIPTION OF THE DRAWINGS

Embodiments of the present invention will be described in detail based on the following figures, wherein.

DETAILED DESCRIPTION OF THE INVENTION

A color printer with an electrophotographic process will be described hereinafter as an example of the application of an intermediate transfer device and an image forming apparatus according to the present invention with reference to the drawings. It should be noted that the image forming apparatus to which the present invention is applied is not limited to the color printer to be described but may be any other type of image forming apparatuses such as copying machines, fax machines, or multifunction machines.

Embodiments of the invention will be described with reference to the drawings. Elements which are not directly related to the nature of the invention will not be described in the embodiments in detail.

Figure 1:
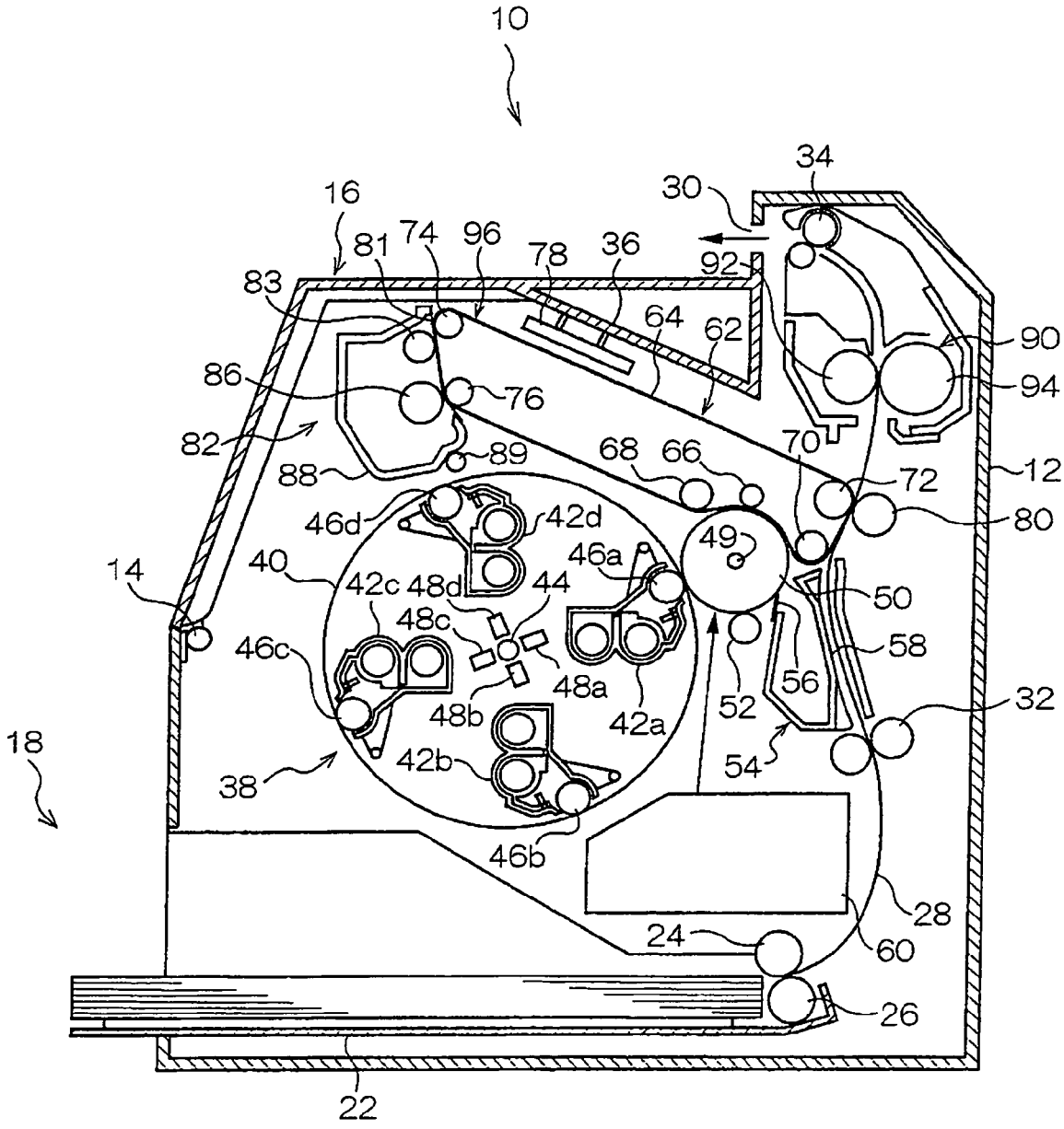
FIG. 1 is a cross-sectional view that typically shows an interior of an intermediate transfer device and an interior of a color printer using the intermediate transfer device according to an embodiment of the present invention.

FIG. 1 depicts outline of an intermediate transfer device 62 and a color printer 10 in which this intermediate transfer device 62 is attached to a color printer main body 12 according to an embodiment of the present invention. The details of the device 62 will be described later.

The color printer 10 includes the color printer main body 12. A rotatable opening and closing cover 16 is provided around a rotation fulcrum 14 in an upper portion of the color printer main body 12. A feeder unit 18 is provided in a lower portion of the color printer main body 12.

The feeder unit 18 includes a paper feed cassette 22 which accommodates recording papers. A feed roll 24 and a retard roll 26 are provided at an upper and inner-most area of the cassette 22. A feed roll 24 rotates to feed a paper P from the cassette 22 and a retard roll 26 handles the supplied recording papers P one by one.

A conveyance path 28 is a path of the recording paper P from the feed roll 24 to a discharge port 30. The conveyance path 28 is formed substantially vertically between the feeder unit 18 and a fuser 90 near a rear side (right side in FIG. 1) of the color printer main body 12. A secondary transfer roll 80 and a secondary transfer backup roll 72 are arranged on the conveyance path 28 upstream of the fuser 90. Resist rolls 32 are arranged upstream of the secondary transfer roll 80 and the secondary transfer backup roll 72. Discharge rolls 34 are arranged on the conveyance path 28 near the discharge port 30.

Therefore, the recording papers P fed out from the paper feed cassette 22 of the feeder unit 18 by the feed roll 24 are handled by the retard roll 26. Only the uppermost recording paper P is introduced to the conveyance path 28, temporarily stopped by the resist rolls 32. Then the uppermost paper P is conveyed to pass between the secondary transfer roll 80 and the intermediate transfer belt 64 (the secondary transfer backup roll 72) at an appropriate timing, thereby transferring toner images onto the uppermost recording paper P. The transferred toner images are fixed onto the paper P by the fuser 90. The resultant paper P is discharged from the discharge port 30 to a discharge section 36 provided on an upper portion of the opening and closing cover 16 by the discharge rolls 34. This discharge section 36 is inclined such that a discharge port is low and other parts are gradually higher toward a frontal direction (left direction in FIG. 1).

A rotary development device 38 is arranged substantially in a central part of the color printer main body 12. The rotary development device 38 includes developing units 42*a* to 42*d* that form toner images of four colors of yellow, magenta, cyan, and black, respectively, within a development device main body 40. The rotary development device 38 rotates leftward or counterclockwise in FIG. 1 around a rotary development device center 44. The development units 42*a* to 42*d* include development rolls 46*a* to 46*d*, and are pressed in a normal direction of the development device main body 40 by elastic bodies 48*a* to 48*d* such as coil springs, respectively.

A photosensitive drum 50 that rotates around a rotation spindle 49 is arranged to be in contact with the rotary development device 38. While the rotary development device 38 is not in contact with the photosensitive drum 50, an outer periphery of each of the development rolls 46*a* to 46*d* partially protrudes by about two millimeters from an outer periphery of the development device main body 40 in a radial direction. Tracking rolls (not shown) with a diameter slightly larger than the diameters of the development rolls 46*a* to 46*d* are provided at both ends of the respective development rolls 46*a* to 46*d* so as to rotate coaxially with the development rolls 46*a* to 46*d*. Namely, the development units 42*a* to 42*d* are arranged around the rotary development device center 44 on the outer periphery of the development device main body 40 at intervals of 90 degrees. While the tracking rolls on the development rolls 46*a* to 46*d* are in contact with flanges (not shown) at both ends of the photosensitive drum 50 and predetermined gaps are formed between the development rolls 46*a* to 46*d* and the drum 50, respectively, the development units 42*a* to 42*d* develop a latent image on the drum 50 by the respective color toners.

A charge roll 52 is provided below the photosensitive drum 50. By applying a charging bias to the charge roll 52, the photosensitive drum 50 is uniformly charged. A photosensitive drum cleaner 54 is provided to be hung from the rotation spindle 49 of the photosensitive drum 50. The photosensitive drum 50 and the photosensitive drum cleaner 54 are formed to be integrated with each other. The photosensitive drum cleaner 54 is composed by a cleaning blade 56 which scrapes off waster toners remaining on the photosensitive drum 50 after a primary transfer, and a toner recovery case 58 which recovers the waste toners scratched up by the cleaning blade 56.

A rib or the like is formed on a rear surface (a right side in FIG. 1) of the toner recovery case 58. The rear surface of the toner recovery case 58 is curved so as to smoothly convey the recording paper P and forms a part of the conveyance path 28.

An exposure device 60 that writes the latent image on the photosensitive drum 50 charged by the charge roll 52 by a beam such as a laser beam is arranged on a lower rear surface side of the rotary development device 38. An intermediate transfer device 62 is provided above the rotary development device 38. The intermediate transfer device 62 subjects the toner images visualized by the rotary development device 38 to the primary transfer by at a primary transfer position and conveys the resultant toner image to a secondary transfer position. The secondary transfer position is a nip part between the secondary transfer roll 80 and the secondary backup roll 72.

The intermediate transfer device 62 is structured to include, for example, the following parts. The intermediate transfer belt 64, a primary transfer roll 66, a wrap-in roll 68, a wrap-out roll 70, the secondary transfer backup roll 72, a cleaning backup roll 74, and a brush backup roll 76.

The intermediate transfer belt 64 is elastic. The intermediate transfer belt 64 is stretched so as to have a generally rectangular shape having long sides and short sides above the rotary development device 38, and to be substantially flat. The both long sides of the intermediate transfer belt 64 are stretched so as to be substantially in parallel to the discharge section 36 provided in the upper portion of the color printer main body 12.

The wrap-in roll 68 is arranged upward of the primary transfer roll 66 on the lower long side of the intermediate transfer belt 64. The intermediate transfer belt 64 includes a primary transfer section (a photosensitive drum wrap region) in contact with the photosensitive drum 50 in a wrapped fashion between the wrap-in roll 68 and the wrap-out roll 70. The primary transfer section of the intermediate transfer belt 64 is wound on the photosensitive drum 50 by a predetermined range, and follows rotation of the photosensitive drum 50. The toner images on the photosensitive drum 50 are primarily transferred onto the intermediate transfer belt 64 by the primary transfer roll 66 while being superimposed on a toner carrying surface 64H (an outer surface) of the intermediate transfer belt 64 in an order of yellow, magenta, cyan, and black. The primarily transferred toner images are conveyed toward the secondary transfer roll 80. The wrap-in roll 68 and the wrap-out roll 70 are distant from the photosensitive drum 50.

The intermediate transfer belt 64 is stretched by the five rolls of the wrap-in roll 68, the wrap-out roll 70, the secondary transfer backup roll 72, the cleaning backup roll 74, and the brush backup roll 76. The primary transfer roll 66 transfers the toner images of the photosensitive drum 50. These rolls are formed to be cylindrical or columnar so as to cyclically stretch and support the intermediate transfer belt 64.

The cleaning backup roll 74 and the brush backup roll 76 are arranged to be away from each other. The distance between the rolls 74 and 76 will form one short side of the intermediate transfer belt 64 when the intermediate transfer belt 64 is stretched substantially flat as described above. Due to this, as compared with a configuration in which the distance between the cleaning backup roll 74 and the brush backup roll 76 is large, a size of the intermediate transfer device 62 can be reduced.

On a rear side (a right side surface in FIG. 1) of the intermediate transfer belt 64, a flat portion (the short side) is formed by the wrap-out roll 70 and the secondary transfer backup roll 72. This flat portion serves as a secondary transfer section so as to face the conveyance path 28.

In the secondary transfer section, the wrap-out roll 70 is arranged so as to form an angle of about 12 degrees between the intermediate transfer belt 64 and the conveyance path 28.

The cleaning backup roll 74 assists a cleaning roll 83, to be described later, in adsorbing and removing the waste toners remaining on the intermediate transfer belt 64 after a secondary transfer. The brush backup roll 76 assists a brush roll 86, to be described later, in scraping off the waste toners remaining on the intermediate transfer belt 64 after the secondary transfer.

A reflection photosensor 78 is provided above the long side of the intermediate transfer belt 64 to be fixed onto a rear surface (an inside surface) of the opening and closing cover 16. The reflection photosensor 78 reads patches of the toners formed on the intermediate transfer belt 64, detects a position of the toner images in a rotation direction of the intermediate transfer belt 64, and also detects densities of the toner images.

The secondary transfer roll 80 is opposite the secondary backup roll 72 of the intermediate transfer device 62 with the conveyance path 28 therebetween. Namely, the position between the secondary transfer roll 80 and the secondary backup roll 72 is the secondary transfer position of the secondary transfer section. The secondary transfer roll 80 secondarily transfers the toner images primarily transferred onto the intermediate transfer belt 64 onto the recording paper P at the secondary transfer position with assistance of the secondary transfer backup roll 72. While the intermediate transfer belt 64 rotates three times, that is, while the toner images of three colors of yellow, magenta, and cyan are primarily transferred onto the intermediate transfer belt 64 in the superimposed manner and conveyed, the secondary transfer roll 80 is kept away from the intermediate transfer belt 64. When the black toner image is transferred, the secondary transfer roll 80 comes in contact with the intermediate transfer belt 64.

The secondary transfer roll 80 and the secondary backup roll 72 are structured to produce a predetermined potential difference therebetween. When a high voltage is applied to the secondary transfer roll 80, the secondary transfer backup roll 72 is connected to the ground.

An intermediate transfer belt cleaner 82 is provided on one end of the intermediate transfer belt 64 opposite a photosensitive drum 50-side end. The intermediate transfer belt cleaner 82 includes a charge control sheet 81, the cleaning roll 83, the brush roll 86, a toner recovery case 88, and a rotation spindle 89, and rocks around the rotation spindle 89. By rocking, the intermediate transfer belt cleaner 82 moves between a contact position (see FIG. 2) at which the charge control sheet 81, the cleaning roll 83, and the brush roll 86 are in contact with the intermediate transfer belt 64 and an out-of-contact position (see FIG. 3) at which the charge control sheet 81, the cleaning roll 83, and the brush roll 86 are out of contact with the intermediate transfer belt 64.

A bias power supply 85 is connected to the charge control sheet and a predetermined bias voltage (e.g., 1700 volt) is applied to the charge control sheet 81. When the charge control sheet 81 comes in contact with the toner carrying surface 64H of the intermediate transfer belt 64, the sheet 81 charges the toners on the toner carrying surface 64H and controls charging amounts of the toners.

The cleaning roll 83, which is made of metal and formed to be cylindrical or columnar, rotates at a circumferential speed substantially equal to a circulation speed of the intermediate transfer belt 64 by a rotary drive source (not shown). Further, the cleaning roll 83 is either grounded by a grounding line 87 or charged to have an opposite polarity to a polarity of the charge-controlled toners on the toner carrying surface 64H, and a potential of the cleaning roll 83 is kept zero volt. Accordingly, an outer peripheral surface (a cleaning surface 83C) of the cleaning roll 83 electrostatically attracts the toners charge-controlled on the toner carrying surface 64H of the intermediate transfer belt 64, and removes (cleans) the toners from the toner carrying surface 64H.

Figure 5:
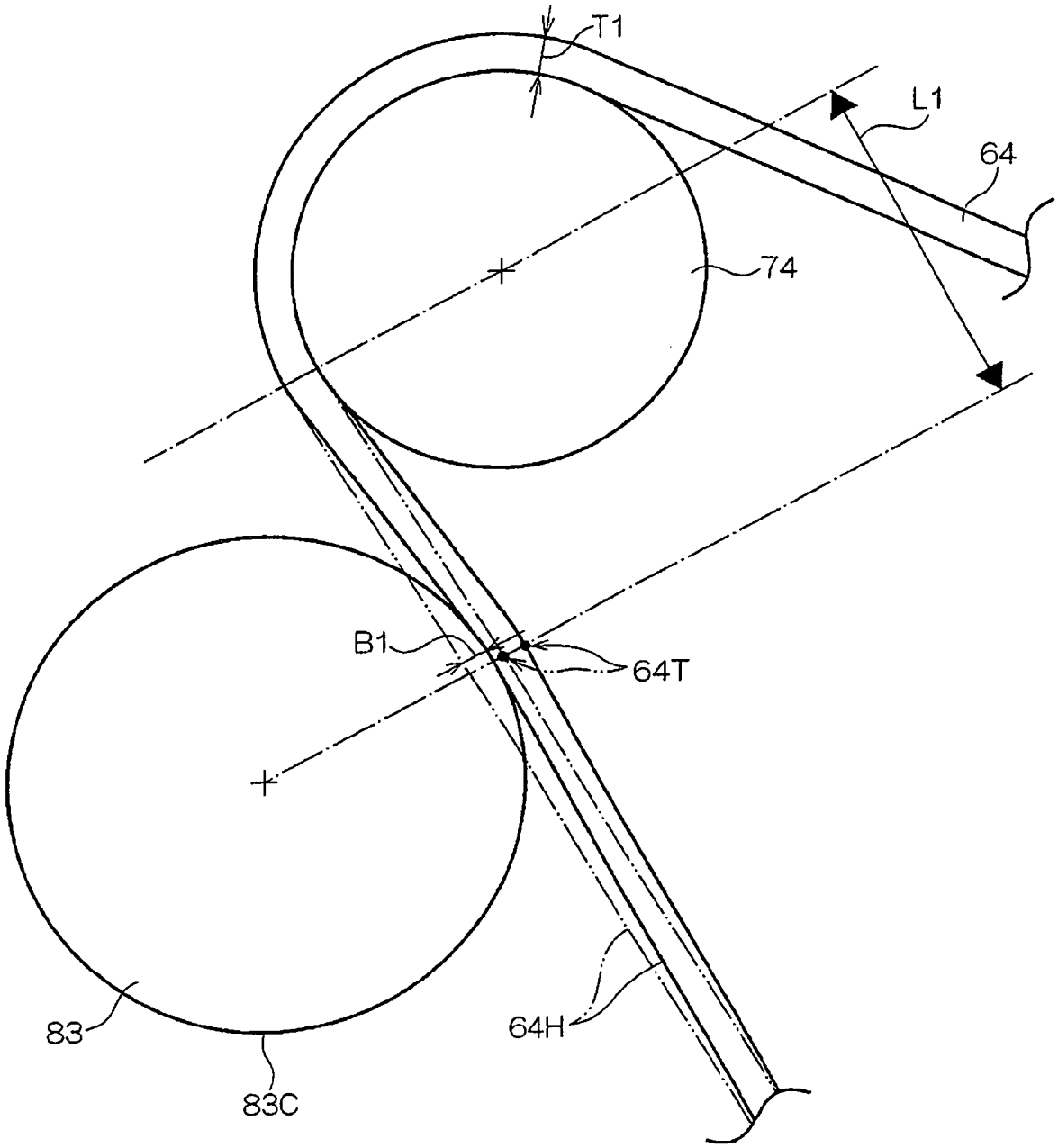
FIG. 5 is an enlarged cross-sectional view that depicts neighborhoods of the cleaning roll of the intermediate transfer device according to the first embodiment of the invention in a state in which the intermediate transfer belt is bent.

In the present embodiment, a position and a moving range of the cleaning roll 83 are determined according to a relationship of the cleaning roll 83 with the cleaning backup roll 74 so that a rear surface contact position 64T, which is on a rear surface of the intermediate transfer belt 64 relative to the contact position at which the cleaning roll 83 comes in contact with the intermediate transfer belt 64, is located away from the cleaning backup roll 74 while the intermediate transfer belt cleaner 82 rocks and moves to the contact position of the cleaner 82. As shown in FIG. 5, in particular, even if the intermediate transfer belt 64 is bent inward because the cleaning roll 83 presses the intermediate transfer belt 64 inward, the position and the moving range of the cleaning roll 83 are determined so that the rear surface contact position 64T is away from the cleaning backup roll 74. Therefore, even while the intermediate transfer belt cleaner 82 cleans the toner carrying surface 64H of the intermediate transfer belt 64 at the contact position, it is possible to prevent the intermediate transfer belt 64 from being put between the cleaning roll 83 and the cleaning backup roll 74.

A bending amount B1 of the intermediate transfer belt 64 when being pressed inward by the cleaning roll 83 is set smaller than a thickness T1 of the intermediate transfer belt 64. Because the intermediate transfer belt 64 is not bent excessively, it is possible to suppress a degree of expansion and contraction of the intermediate transfer belt 64 to be smaller.

Further in this embodiment, a center of the cleaning roll 83 is located such that a length L1 from a contact end 74T of a contact portion of the intermediate transfer belt 64, in which the belt 64 contacts with the cleaning backup roll 74, to the rear surface contact position 64T is equal to or larger than the length corresponding to a radius R1 of the cleaning backup roll 74. Therefore, as compared with the configuration in which the center of the cleaning roll 83 is located to be close to the cleaning backup roll 74 such that the length L1 is at a position within the radium R1, a repulsive force acting on the cleaning roll 83 from the bent intermediate transfer belt 64 is small.

The brush roll 86 further scrapes off the waste toners remaining after the cleaning by the cleaning roll 83. The toner recovery case 88 recovers the waste toners cleaned by the cleaning roll 83 and the brush roll 86.

The brush roll 86 is composed by an acrylic brush or the like to which a conductive processing is carried out. While the intermediate transfer belt 64 conveys the toner images, the cleaning roll 83 and the brush roll 86 are away from the intermediate transfer belt 64. At a predetermined timing, the cleaning roll 83 and the brush roll 86 come in contact with the intermediate transfer belt 64 together.

The intermediate transfer device 62, the photosensitive drum 50, the charge roll 52, the photosensitive drum cleaner 54, and the intermediate transfer belt cleaner 82 are integrated to structure an image formation unit 96.

A fuser 90 is arranged above the secondary transfer position. The fuser 90 includes a heating roll 92 and a pressure roll 94. The fuser 90 fuses the toner images secondarily transferred onto the recording paper P by the secondary transfer roll 80 and the secondary transfer backup roll 72 onto the recording paper P, and conveys the resultant recording paper P toward the discharge rolls 34. The discharge roll 34 discharges the recording paper P from the discharge port 30 to the discharge section 36 provided on an upper portion of the opening and closing cover 16.

A function of the color printer according to the present embodiment will be described next.

Figure 2:
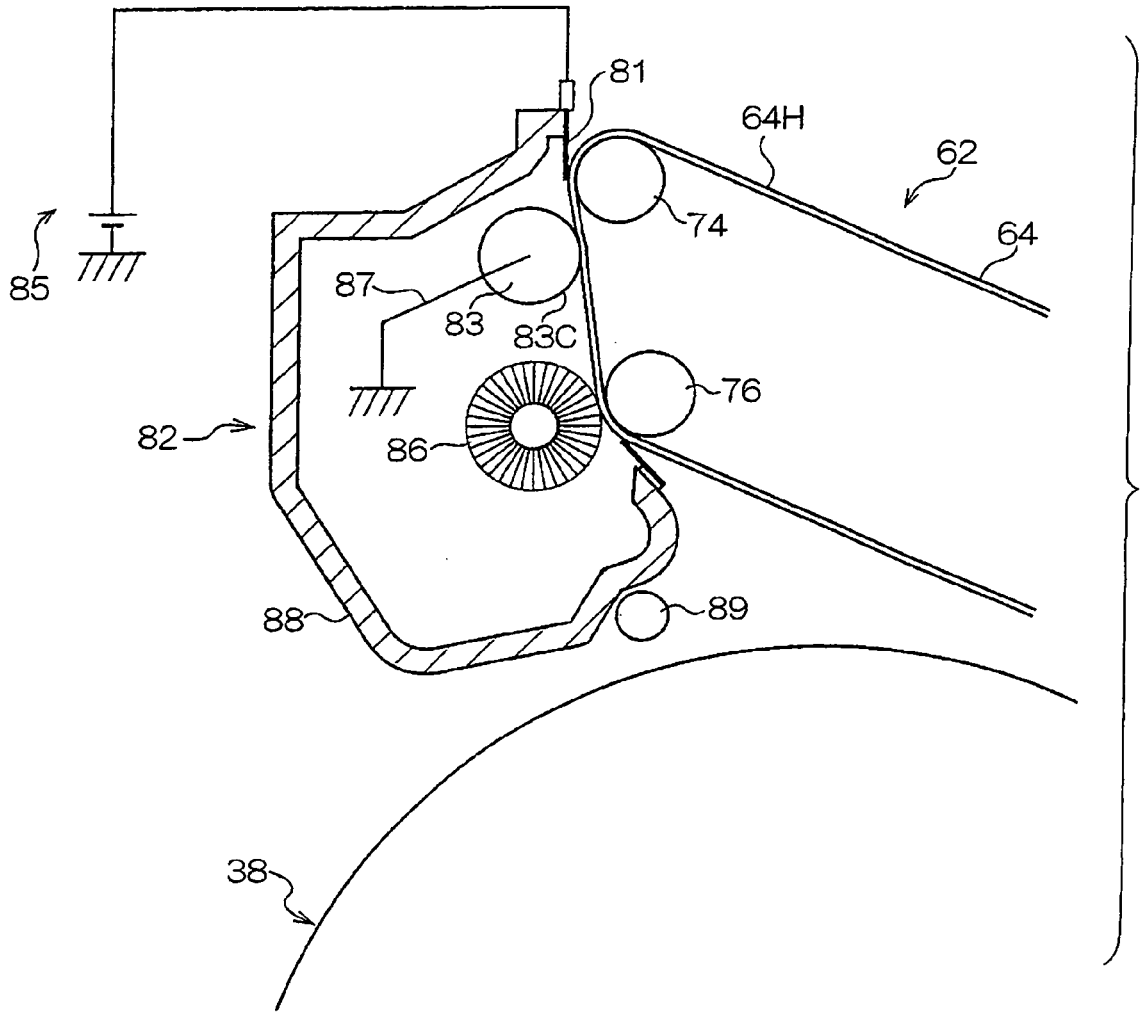
FIG. 2 is an enlarged cross-sectional view that depicts neighborhoods of an intermediate transfer belt cleaner of the intermediate transfer device according to a first embodiment of the invention at a position at which the intermediate transfer belt cleaner is in contact with an intermediate transfer belt.

If an image is to be formed, and toners (normal toners) used for image formation are not present on the toner carrying surface 64H of the intermediate transfer belt 64 (e.g., immediately after the intermediate transfer belt 64 is driven to circulate), the intermediate transfer belt cleaner 82 is located at the contact position. In addition, the charge control sheet 81, the cleaning roll 83, and the brush roll 86 are brought into contact with the toner carrying surface 64H of the intermediate transfer belt 64, as shown in FIG. 2.

Figure 3:
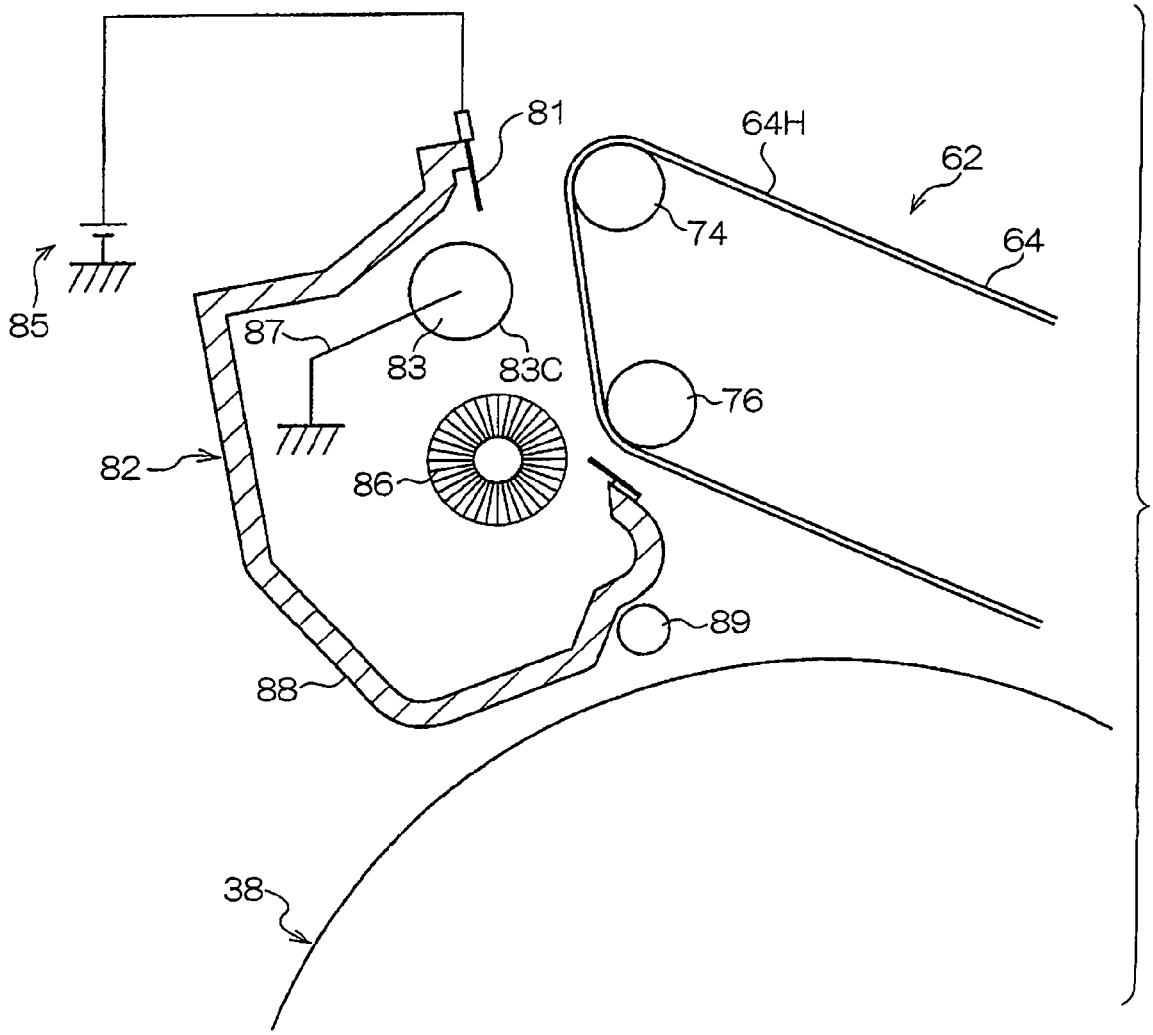
FIG. 3 is an enlarged cross-sectional view that depicts neighborhoods of an intermediate transfer belt cleaner of the intermediate transfer device according to the first embodiment of the invention at a position at which the intermediate transfer belt cleaner is out of contact with the intermediate transfer belt.
Figure 4:
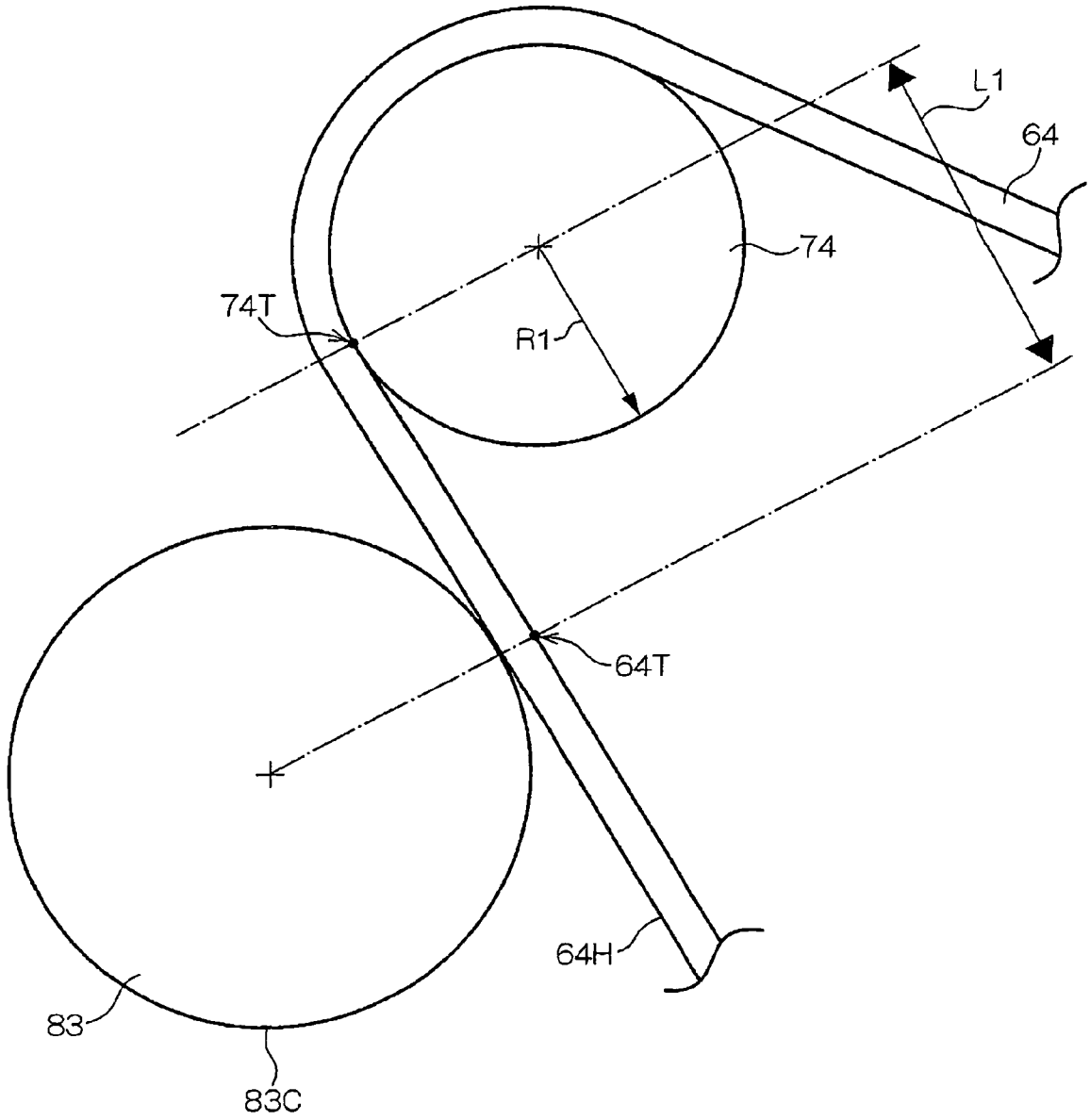
FIG. 4 is an enlarged cross-sectional view that depicts neighborhoods of a cleaning roll of the intermediate transfer device according to the first embodiment of the invention at positions at which the cleaning roll are in contact with the intermediate transfer belt.

If the image is to be formed, and the normal toners are present on the toner carrying surface 64H of the intermediate transfer belt 64, the intermediate transfer belt cleaner 82 is located at the out-of-contact position. In addition, the charge control sheet 81, the cleaning roll 83, and the brush roll 86 are made way the toner carrying surface 64H of the intermediate transfer belt 64, as shown in FIG. 3. By doing so, a pre-set is allowed to ensure cleaning of the toner carrying surface 64H of the intermediate transfer belt 64 only when the cleaning is necessary, and non-removing of the toners inadvertently when the cleaning is unnecessary.

When an image formation signal is transmitted to the color printer, a driving force is transmitted to a driving gear of the photosensitive drum 50 by an unillustrated driving mechanism to rotate the photosensitive drum 50.

The photosensitive drum 50 is uniformly charged by the charge roll 52. A beam is emitted to this charged photosensitive drum 50 from the exposure device 60 based on the image signal. The beam from the exposure device 60 exposes a surface of the photosensitive drum 50 to form a latent image. The latent image on the photosensitive drum 50 formed by the exposure device 60 is developed to the toner images of yellow, magenta, cyan, and black by the rotary development device 38. The toner images are superimposed on the intermediate transfer belt 64 and primarily transferred onto the belt 64. In the primary transfer, the waste toners remaining on the photosensitive drum 50 are scraped off and recovered by the photosensitive drum cleaner 54.

When a paper feed signal is transmitted to the color printer, the recording papers P stored in the paper feed cassette 22 are fed out by the feed roll 24. The recording papers P are handled by the retard roll 26 and introduced to the conveyance path 28. The recording papers P are temporarily stopped by the resist rolls 32. The recording papers P are introduced into between the secondary transfer roll 80 and the secondary backup roll 72 at predetermined intervals. When one recording paper P is introduced into between the secondary transfer roll 80 and the secondary backup roll 72, the toner images primarily transferred onto the intermediate transfer belt 64 are secondarily transferred onto the recording paper P by the secondary transfer roll 80 and the secondary transfer backup roll 72.

The recording paper P onto which the toner images are transferred is introduced to the fuser 90, in which the toner images are fixedly attached onto the recording paper P by being heated and pressurized by the heating roller 92 and the pressure roller 94. The recording paper P onto which the toner images are fixedly attached is discharged from the discharge port 30 to the discharge section 36 by the discharge rolls 34.

After the secondary transfer, the waste toners remaining on the toner carrying surface 64H of the intermediate transfer belt 64 are removed and recovered by the intermediate transfer belt cleaner 82. Namely, the waste toners on the toner carrying surface 64H of the intermediate transfer belt 64 are first change-controlled to each have the predetermined charge amount by the charge control sheet 81. The cleaning surface 83C of the cleaning roll 83 electrostatically attracts the charge-controlled toners on the toner carrying surface 64H of the intermediate transfer belt 64, thereby removing (cleaning) the toners from the toner carrying surface 64H. At this time, the cleaning roll 83 rotates at the circumferential speed substantially equal to the circulation speed of the intermediate transfer belt 64. This can, therefore, reduce a force in a circulation direction acting on the intermediate transfer belt 64 from the cleaning roll 83, and reduce expansion or contraction of the intermediate transfer belt 64.

In the present embodiment, even while the cleaning roll 83 comes in contact with the intermediate transfer belt 64 to press the intermediate transfer belt 64 inward, and the intermediate transfer belt 64 is bent inward, the rear surface contact position 64T is away from the cleaning backup roll 74. Due to this, during the cleaning, the intermediate transfer belt 64 is not put between the cleaning roll 83 and the cleaning backup roll 74. As a result, a change in the degree of expansion and contraction caused by locally putting the intermediate transfer belt 64, which is circulating, between the rolls is made slow, so that the intermediate transfer belt 64 is kept at the degree of expansion and contraction within a predetermined range.

Moreover, according to this embodiment, the bending amount B1 of the intermediate transfer belt 64 due to pressing of the belt 64 by the cleaning roll 83 is set smaller than the thickness T1 of the intermediate transfer belt 64. As a result excessive bending of the intermediate transfer belt 64 is prevented and the suppression of the degree of contraction of the intermediate transfer belt 64 is maintained to be small.

In this way, the toner images on the toner carrying surface 64H of the intermediate transfer belt 64 become less prone the change in the degree of expansion and contraction of the intermediate transfer belt 64. This means that the degradation of image quality is prevented.

Furthermore, according to this embodiment, the center of the cleaning roll 83 is located such that the length L1 is equal to or larger than the distance corresponding to the radius R1. The repulsive force acting on the cleaning roll 83 from the bent intermediate transfer belt 64 is thereby set smaller. Therefore, a frictional force produced between the cleaning roll 83 and the intermediate transfer belt 64 is lower, and the cleaning roll 83 slides on the intermediate transfer belt 64 more smoothly. Although the circumferential speed of the cleaning roll 83 is controlled to be substantially equal to the circulation speed of the intermediate transfer belt 64, a slight variation in rotational speed may occur. If the frictional force between the cleaning roll 83 and the intermediate transfer belt 64 is significantly high, this variation will act on the intermediate transfer belt 64 to change the degree of expansion and contraction of the intermediate transfer belt 64 or change the circulation speed of the belt 64. According to this embodiment, by allowing the cleaning roll 83 to slide smoothly on the intermediate transfer belt 64, the circulation speed of the intermediate transfer belt 64 reaches a stable value and an influence of the cleaning roll 83 on the circulation of the intermediate transfer belt 64 is reduced. Accordingly, a fluctuation in the circulation speed of the intermediate transfer belt 64 resulting from the variation of rotation of the cleaning roll 83 is mitigated and the intermediate transfer belt 64 can be run stably.

The cleaning roll 83 is arranged and held to be in uniform contact with the intermediate transfer belt 64 in a longitudinal direction of the cleaning roll 83. However, depending on a relationship of the cleaning roll 83 with the intermediate transfer belt 64, a phenomenon that only one end of the cleaning roll 83 slightly in the longitudinal direction strongly contacts with the intermediate transfer belt 64 may possibly occur. According to this embodiment, the risk of such a phenomenon can be lessened because the repulsive force acting on the cleaning roll 83 from the bent intermediate transfer belt 64 is made lower.

Figure 6:
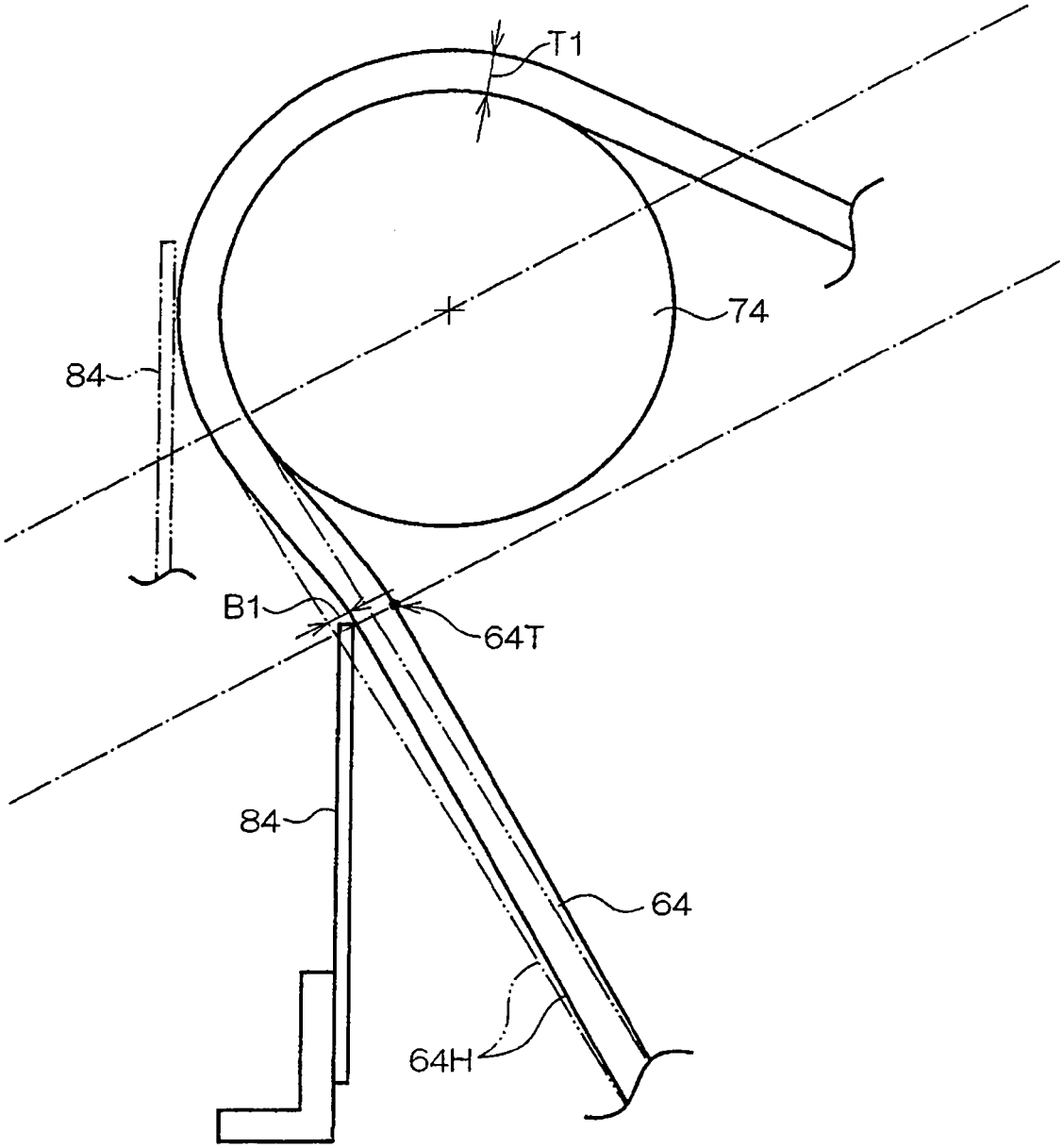
FIG. 6 is an enlarged cross-sectional view that depicts neighborhoods of a scraper of an intermediate transfer device according to a second embodiment of the invention in a state in which an intermediate transfer belt is bent.

FIG. 6 is an enlarged view of neighborhoods of an intermediate transfer belt cleaner of an intermediate transfer device according to a second embodiment of the invention.

The second embodiment differs from the first embodiment in that a scraper 84 is used in place of the cleaning roll 83 in the first embodiment.

The scraper 84 is made of, for example, a metal (e.g., stainless steel) or a resin (e.g., resin-coated urethane rubber) to be a thin plate. A cleaning section on a tip end of the scraper 84 is arranged to be directed in an opposite direction to the circulation direction of the intermediate transfer belt 64 and to be in contact with the toner carrying surface 64H. Further, a voltage having an opposite polarity to that of the waste toners on the toner carrying surface 64H of the intermediate transfer belt 64 is applied to the scraper 84.

Similarly to the cleaning roll 83 in the first embodiment, therefore, the scraper 84 scrapes off and cleans the waste toners remaining on the intermediate transfer belt 64 after the secondary transfer while adsorbing the waste toners.

Similarly to the cleaning roll 83 in the first embodiment, a position and a moving range of the scraper 84 are determined according to a relationship of the scraper 84 with the cleaning backup roll 74 such that a rear surface contact position 64T, which is on a rear surface of the intermediate transfer belt 64 relative to the contact position at which the scraper 84 comes in contact with the intermediate transfer belt 64, is located away from the cleaning backup roll 74. In particular, even if the intermediate transfer belt 64 is bent inward because the scraper 84 presses the intermediate transfer belt 64 inward, the position and the moving range of the scraper 84 are determined such that the rear surface contact position 64T is away from the cleaning backup roll 74. Therefore, even while the intermediate transfer belt cleaner 82 cleans the toner carrying surface 64H of the intermediate transfer belt 64 at the contact position, the intermediate transfer belt 64 can be prevented from being put between the scraper 84 and the cleaning backup roll 74.

The bending amount B1 of the intermediate transfer belt 64 when being pressed inward by the scraper 84 is set smaller than the thickness T1 of the intermediate transfer belt 64. Because the intermediate transfer belt 64 is not bent excessively, the degree of expansion and contraction of the intermediate transfer belt 64 can be suppressed to be smaller.

As a result, according to the second embodiment, similarly to the first embodiment, a change in the degree of expansion and contraction caused by locally putting the intermediate transfer belt 64, which is circulating, between the rolls is made slow. The intermediate transfer belt 64 is thus kept at the degree of expansion and contraction within a predetermined range.

Furthermore, the scraper 84 is arranged to be directed in an opposite direction (a so-called doctor direction) to the circulation direction of the intermediate transfer belt 64 and to be in contact with the toner carrying surface 64H. Due to this, portions of the scraper 84 other than the tip end from can be prevented form coming in contact with the toner carrying surface 64H of the intermediate transfer belt 64. Such portions are, for example, an intermediate portion of the scraper 84 from coming in contact with a so-called belly portion of the toner carrying surface 64H, see the scraper 84 indicated by a two-dot chain line in FIG. 6. Cleaning of the toner carrying surface 64H can be ensured.

The instance in which the cleaning roll 83 or the scraper 84 consists of a metal has been described in the first and the second embodiments. However, a material for the cleaning roll 83 or the scraper 84 is not limited to a specific material as long as the cleaning roll 83 or the scraper 84 can ensure removal of the waste toners remaining on the toner carrying surface 64H of the intermediate transfer belt 64. It is noted, however, that if the cleaning roll 83 or the scraper 84 consists of a metal as described in the first and the second embodiments, a characteristic change of the cleaning roll 83 or the scraper 84 relative to a change in an environment (e.g., a temperature or a humidity) can be suppressed small, as compared with the cleaning roll 83 or the scraper 84 consisting of a material other than the metal. This can, therefore, prevent a fluctuation in a load of the cleaning roll 83 or the scraper 84 exerted to the intermediate transfer belt 64.

Furthermore, a medium on which an image is formed by the color printer 10 according to the invention is not limited to the recording paper P but may be, for example, an OHP sheet (transparencies).

According to the invention, the intermediate transfer device may be structured to arrange the cleaning member such that the rear surface of the intermediate transfer belt is at the position away from the belt support member while the cleaning member is caused to press the intermediate transfer belt to thereby bend the intermediate transfer belt by the cleaning member support mechanism.

By bending the intermediate transfer belt to bring the cleaning surface into contact with the toner carrying surface of the intermediate transfer belt, a contact area effective to the cleaning can be obtained. In addition, even while the intermediate transfer belt is bent, the intermediate transfer belt is not put between the cleaning member and the belt support member. Accordingly, the change in the degree of expansion and contraction of the intermediate transfer belt in the circulation direction of the intermediate transfer belt and a direction orthogonal to the circulation direction can be made slow.

According to the invention, the bending amount of the intermediate transfer belt may be set smaller than the thickness of the intermediate transfer belt.

By so setting, the intermediate transfer belt is not bent excessively. Accordingly, the change in the degree of expansion and contraction of the intermediate transfer belt in the circulation direction of the intermediate transfer belt and a direction orthogonal to the circulation direction can be suppressed effectively. Besides, image quality degradation resulting from the bending of the intermediate transfer belt can be suppressed.

According to the invention, the cleaning member may be a rotary cleaning member rotatable along the circulation direction of the intermediate transfer belt.

In this case, the cleaning surface (outer peripheral surface) of the rotary cleaning member is rotated while being in contact with the toner carrying surface of the intermediate transfer belt, thereby making it possible to clean the toner carrying surface. If the bending amount of the intermediate transfer belt is set smaller than the thickness of the intermediate transfer belt, in particular, the repulsive force acting on the rotary cleaning member from the intermediate transfer belt is low, as compared with the configuration in which the bending amount is set equal to or larger than the thickness of the intermediate transfer belt. This enables the rotary cleaning member to slide on the intermediate transfer belt more smoothly. By allowing the rotary cleaning member to slide smoothly on the intermediate transfer belt, the circulation speed of the intermediate transfer belt saturates. As a result, a fluctuation in the circulation speed of the intermediate transfer belt resulting from the variation of rotation of the rotary cleaning member is lessened, thereby making it possible to more stably circulate the intermediate transfer belt.

According to the invention, at least one of the plurality of belt support members may be a cylindrical or columnar belt support roll. In addition, the cleaning member may be arranged so that the rotation center of the rotary cleaning member is at the position away from an end of the contact portion in which the belt support roll contacts with the intermediate transfer belt by the distance corresponding to the radius of the belt support roll or more.

In this case, as compared with the configuration in which the center of the rotary cleaning member is located to be closer to an end of the contact portion of the belt support roll with the intermediate transfer belt than the distance corresponding to the radius of the belt support roll, the repulsive force acting on the rotary cleaning member from the intermediate transfer belt is small. This enables the rotary cleaning member to slide on the intermediate transfer belt more smoothly. By allowing the rotary cleaning member to slide smoothly on the intermediate transfer belt, the circulation speed of the intermediate transfer belt saturates. As a result, the fluctuation in the circulation speed of the intermediate transfer belt resulting from the variation of rotation of the rotary cleaning member is lessened, thereby making it possible to more stably circulate the intermediate transfer belt.

Furthermore, the rotary cleaning member comes in contact with the intermediate transfer belt while the repulsive force from the intermediate transfer belt is reduced. Therefore, the probability of occurrence of the phenomenon that only one end of the rotary cleaning member slightly in the longitudinal direction comes in strong contact with the intermediate transfer belt and a subsequent belt walk phenomenon can be reduced.

According to the invention, the cleaning member support mechanism may include a configuration of supporting the rotary cleaning member so that a cleaning surface on an outer periphery of the rotary cleaning member can be made in contact with or out of contact with the toner carrying surface.

With this configuration, the cleaning surface is brought into contact with the toner carrying surface only when it is necessary to clean the toner carrying surface. The cleaning surface is made apart from the toner carrying surface when the cleaning is unnecessary. This can thereby prevent the toners from being inadvertently removed from the toner carrying surface, and prevent a load from being exerted on the intermediate transfer belt. Besides, the rotation center of the rotary cleaning member is away from the end of the contact portion of the belt support roll with the intermediate transfer belt by the distance corresponding to the radius of the belt support roll or more. Due to this arrangement of the rotation center, an impact will be reduced, which is produced when the cleaning surface comes in contact with or out of contact with the toner carrying surface.

According to the invention, the cleaning member may include the scraper directed in the opposite direction to the circulation direction of the intermediate transfer belt and coming in contact with the toner carrying surface.

With this configuration, the toner carrying surface can be cleaned only by bringing the scraper into contact with the toner carrying surface.

Furthermore, the scraper is arranged to be directed in an opposite direction (a so-called doctor direction) to the circulation direction of the intermediate transfer belt and to be in contact with the toner carrying surface. Due to this, it is possible to prevent portions of the scraper other than the tip end (e.g., the intermediate portion of the scraper) from coming in contact with the toner carrying surface. It is thereby possible to ensure cleaning the toner carrying surface.

Because the invention is structured as stated above, it is possible to ensure removing the transfer residual toners from the elastic intermediate transfer belt, and to make the expansion and contraction of the intermediate transfer belt slow.

What is claimed is:

1. An intermediate transfer device comprising:

an intermediate transfer belt which is formed endlessly, supported by a plurality of belt support members, and is capable of circulating, with elasticity at least in a circulation direction;

a cleaning member that comes in contact with a toner carrying surface of the intermediate transfer belt to remove a toner on the toner carrying surface of the intermediate transfer belt; and a cleaning member support mechanism movably supporting the cleaning member to make a cleaning surface of the cleaning member come in contact with or out of contact with the toner carrying surface, wherein the cleaning member is arranged so that a rear surface of the intermediate transfer belt at a contact position, at which the cleaning surface is brought into contact with the toner carrying surface by the cleaning member support mechanism, is at a position away from the belt support members so that there is an empty space directly on the rear surface side of the intermediate transfer belt at the contact position and a portion of the intermediate transfer belt bent by the cleaning member enters the empty space; and wherein a bending amount of the intermediate transfer belt is set smaller than a thickness of the intermediate transfer belt.

2. An intermediate transfer device according to claim 1, wherein the cleaning member is arranged so that the rear surface of the intermediate transfer belt at the contact position is at the position away from the belt support member while the cleaning member is caused to press the intermediate transfer belt to thereby bend the intermediate transfer belt by the cleaning member support mechanism.

3. An intermediate transfer device according to claim 1, wherein the cleaning member includes a rotary cleaning member rotatable along the circulation direction of the intermediate transfer belt.

4. An intermediate transfer device according to claim 3, wherein at least one of the plurality of belt support members is a cylindrical belt support roll, and the cleaning member is arranged so that a rotation center of the rotary cleaning member is at a position away from an end of a contact portion in which the belt support roll contacts with the intermediate transfer belt by a distance corresponding to a radius of the belt support roll or more.

5. An intermediate transfer device according to claim 3, wherein at least one of the plurality of belt support members is a columnar belt support roll, and the cleaning member is arranged so that a rotation center of the rotary cleaning member is at a position away from an end of a contact portion in which the belt support roll contacts with the intermediate transfer belt by a distance corresponding to a radius of the belt support roll or more.

6. An intermediate transfer device according to claim 3, wherein the cleaning member support mechanism supports the rotary cleaning member so that a cleaning surface on an outer periphery of the rotary cleaning member can be made in contact with or out of contact with the toner carrying surface.

7. An intermediate transfer device according to claim 1, wherein the cleaning member includes a scraper directed in an opposite direction to the circulation direction of the intermediate transfer belt and coming in contact with the toner carrying surface.

8. An intermediate transfer device according to claim 1, wherein the circumferential speed of the cleaning roll is controlled to be substantially equal to the circulation speed of the intermediate transfer belt.

9. An image forming apparatus comprising:

an intermediate transfer device, the intermediate transfer device including:

an intermediate transfer belt formed endlessly, supported by a plurality of belt support members so that the intermediate transfer belt can circulate, and having elasticity at least in a circulation direction;

a cleaning member that comes in contact with a toner carrying surface of the intermediate transfer belt to remove a toner on the toner carrying surface of the intermediate transfer belt; and a cleaning member support mechanism movably supporting the cleaning member so that a cleaning surface of the cleaning member is in contact with or out of contact with the toner carrying surface, wherein the cleaning member being arranged so that a rear surface of the intermediate transfer belt at a contact position, at which the cleaning surface is brought into contact with the toner carrying surface by the cleaning member support mechanism, is at a position away from the belt support members so that there is an empty space directly on the rear surface side of the intermediate transfer belt at the contact position and a portion of the intermediate transfer belt bent by the cleaning member enters the empty space;

a primary transfer section that primarily transfers a toner image onto the intermediate transfer device; and a secondary transfer section that secondarily transfers the toner image on the intermediate transfer belt onto a recording medium; and wherein a bending amount of the intermediate transfer belt is set smaller than a thickness of the intermediate transfer belt.

10. A method of structuring a cleaning member applicable to an image intermediate transfer device, the intermediate transfer device comprising an intermediate transfer belt supported to be capable of circulating, and having elasticity at least in a circulation direction, a cleaning member that comes in contact with a toner carrying surface of the intermediate transfer belt to remove a toner on the toner carrying surface of the intermediate transfer belt, and a cleaning member support mechanism movably supporting the cleaning member to make a cleaning surface of the cleaning member come in contact with or out of contact with the toner carrying surface, the method comprising:

arranging the cleaning member to make a rear surface of the intermediate transfer belt come at a contact position, at which the cleaning surface is brought into contact with the toner carrying surface by the cleaning member support mechanism, is at a position away from the belt support members so that there is an empty space directly on the rear surface side of the intermediate transfer belt at the contact position and a portion of the intermediate transfer belt bent by the cleaning member enters the empty space; and setting a bending amount of the intermediate transfer belt smaller than a thickness of the intermediate transfer belt.

11. The method of claim 10, further comprising:

arranging the cleaning member to make the rear surface of the intermediate transfer belt at the contact position come at the position away from the belt support member while the cleaning member is caused to press the intermediate transfer belt to thereby bend the intermediate transfer belt by the cleaning member support mechanism.

12. The method of claim 10, wherein at least one of the plurality of belt support members is one of a cylindrical belt support roll and a columnar belt support roll, and the method further comprises arranging the cleaning member so that a rotation center of the rotary cleaning member is at a position away from an end of a contact portion in which the belt support roll contacts with the intermediate transfer belt by a distance corresponding to a radius of the belt support roll or more.

* * * * *